United States Patent [19]

Perner

[11] Patent Number: 4,962,595

[45] Date of Patent: Oct. 16, 1990

[54] SKI SHOE

[75] Inventor: Johann Perner, Graz, Austria

[73] Assignee: Koflach Sport Gesellschaft m.b.H. & Co. KG, Vocklabruck, Austria

[21] Appl. No.: 404,980

[22] Filed: Sep. 11, 1989

[30] Foreign Application Priority Data

Sep. 9, 1988 [AT] Austria ..... 2221/88

[51] Int. Cl.[5] ..... A43B 5/04

[52] U.S. Cl. ..... 36/121; 36/117

[58] Field of Search ..... 36/117–121

[56] References Cited

U.S. PATENT DOCUMENTS

| | | | |
|---|---|---|---|
| 3,543,421 | 2/1969 | Ader | 36/121 |
| 3,619,914 | 11/1971 | Hanson et al. | 36/121 |
| 3,633,291 | 1/1972 | Caporicci | 36/121 |
| 4,060,256 | 11/1977 | Collombin et al. | 36/121 X |
| 4,367,885 | 1/1983 | Ramer | 36/121 X |
| 4,404,758 | 9/1983 | Kopp | 36/121 |
| 4,455,769 | 6/1984 | Fritsch | 36/121 |
| 4,501,078 | 7/1985 | Kopp | 36/121 |
| 4,519,149 | 6/1985 | Pozzobon | 36/121 |
| 4,575,958 | 3/1986 | Arieh et al. | 36/121 |
| 4,665,635 | 6/1987 | Benoit et al. | 36/120 |
| 4,761,899 | 8/1988 | Marxer | 36/121 |

FOREIGN PATENT DOCUMENTS 2057094 5/1972 Fed. Rep. of Germany .

*Primary Examiner*—Paul T. Sewell
*Assistant Examiner*—Andrew D. Meyers
*Attorney, Agent, or Firm*—Nixon & Vanderhye

[57] ABSTRACT

In ski shoe (1) with a shell (2) and upper or cuff (3) pivotably hinged on the shell, in which shell and upper or cuff are connected to one another in the heel area by a spring element and tension member (6) that engages the spring element is pivotably attached on shell (2), tension member (6) consists of at least two parts (8, 10) that can be slid lengthwise in relation to one another and parts (8, 10) of tension member (6) can be detachably locked with one another in at least one slide position. In this case the design is chosen so that spring (12) placed between second part (10) of tension member (6) and upper or cuff (3) encompasses second part (10) on the outside and is placed between spring plate (17) that can be slid in the axial direction of second part (10) and can be fixed in the respective slide position and disk (16) exhibiting support pins (15), and disk (16) exhibiting support pins (15) can be slid on the outside of second part (10) in axial direciton of the same against the force of spring (12). (FIG. 1).

7 Claims, 3 Drawing Sheets

SKI SHOE

The invention relates to a ski shoe with a shell and an upper or a cuff pivotably hinged on the shell, in which the shell and the upper or cuff are connected to another in the heel area by a spring element and a tension member that engages the spring element that is pivotably attached on the shell, and the tension member consists of at least two parts that can be slid lengthwise relative to one another and the parts of the tension member can be detachably locked with one another in at least one slide position, and a first part of the tension member is pivotably attached on the shell and a second part of the tension member on the upper or the cuff.

To absorb the movement of an upper or a cuff relative to the shell a series of various devices have become known. Among others a device between the upper and the shell has become known from DE-OS No. 19 64 402 and in two components are telescoped in one other and one of the two components connected to the upper or the shell dips into the other component with a friction lock. Depending on the adjustment of the frictional forces in such a design a variable absorption of the movement is achieved. The majority of the devices that have become known, precisely speaking, do not present any absorption but rather an elastic limiting of the swing path. Thus for example from German utility model G 85 14 965 a device with a tension member passing through a coil spring has become known, in which, when the upper is pivoted relative to the shell, the spring is more or less put under stress. Such a design mentioned above corresponds to a previously known ski shoe that can be found on the market. According to a further previously known design, between the shell and the upper a combined, elastic and absorbing element was used which was able to absorb movements in both directions starting from a preselected resting position. Such a design is relatively costly and expensive and moreover because of its design is connected with relatively large dimensions.

The object of the invention is now to create such a device mentioned above that with small dimensions with little wear or stress particularly of the bearings can elastically absorb great forces and which at the same time makes it possible to guarantee with simple means a horizontal swing of the upper from the forward lean position into a walking position or an upright position free of elastic forces. At the same time it should be possible to produce the ski shoe according to the invention so that as a result of the cushioning or absorption of the forward lean movement of the upper it is not considerably heavier nor considerably larger than regular ski shoes without such devices. To attain this object the ski shoe according to the invention with a device of the above mentioned kind essentially consists in that the spring placed between the second part of the tension member and the upper or the cuff encompasses the second part from the outside and is placed between a spring plate that can be slid in the axial direction of the second part and that can be fixed in the respective shift position and a disk exhibiting pivot pins, whereby the disk exhibiting pivot pins on the outer side of the second part runs slidably in its axial direction against the force of the spring. By having a spring plate exhibit pivot pins, on the one hand a stable support of the elastic forces is achieved and on the other hand a flexible connection of the part of the tension member that is encompassed by the spring is achieved on the upper or the cuff. This additional flexibility makes it possible to absorb even sharp deformations of the upper and the shell, and particularly high pivotal angles into the forward lean position without excessive wear on the connection places on the upper or the cuff. The elastic force is thus diverted not directly into parts of a bearing block consisting mainly of plastic, but rather into a support disk placed on the outer side of the tension member, whereby an eccentric introduction of elastic forces into the bearing itself or the bearing block on the upper or the cuff is avoided. Thus the wear on the components of the absorption device, particularly of the tension member, and the wear on the bearings is kept small even with great elastic forces. Since the tension member is subdivided into several parts, a locking and unlocking of these parts can be further accomplished in a simple manner so that despite the spring load of one of the components of the tension member, by simple unlocking a release takes place and the upper can be pivoted unstressed into a walking position. By locking the parts of the tension member the operational position can be adjusted in which first the horizontal swing into the forward lean against the force of a spring takes place so that a certain degree of forward lean absorption is achieved. By locking the components in this case the initial position is adjusted in which a minimum forward lean or a maximum backward lean can be predetermined, and the subdivision of the tension member into several parts makes it possible to achieve corresponding stops for the maximum backward lean, as well as an adjustment of the forward lean angle with simple means from a construction standpoint. At the same time a high degree of stability is ensured and sufficient reach can be found with small components.

Advantageously the design is chosen so that the first part of the tension member pivotably attached on the shell is placed dipping into the second part of the tension member that passes through a bearing on the upper or the cuff. By making the one part of the tension member dip into the other part of the tension member, proper movement of individual parts of the tension member on or in one another is guaranteed and the elastic forces can be brought to bear in a precisely adjustable manner in the axial direction of the tension member.

To precisely limit the maximum acceptable backward lean position or the minimum forward lean position when the individual parts of the tension member are locked with one another, the design is advantageously chosen so that the second part of the tension member that passes through the bearing on the upper or the cuff exhibits stops to limit the swing path of the cuff or the upper into the backward lean in the locked position of both parts of the tension member. Such a design makes it possible to hold the second part of the tension member that works directly together with the spring on the cuff or the upper and in a particularly simple manner makes it possible to uncouple the first part that dips into this part which is pivotably hinged on the shell from this second part, to achieve a release into the walking position.

The design of the additional spring plate that can be slid along the tension member as a part of the bearing in the form of a support disk with support pins furthermore offers the possibility, in a simple manner, of also precisely limiting the minimum forward lean or the maximum backward lean and of making use of the same component as a counterstop for a stop on the outer side of the part of the tension member that passes through the support disk. The design in this case is advantageously chosen so that the disk exhibiting the support pins with a maximum horizontal swing of the upper or the cuff into the backward lean works together with the stops for limiting the backward lean on the outside of the second part of the tension member and so that the support pins are received in recesses or bores of a bearing block that is attached on the upper or cuff, particularly designed as one piece with the upper or cuff. Even the forces to be absorbed by limiting the backward lean or the preadjustment of the minimum forward lean are thus absorbed with interposition of a relatively stable component, namely the spring plate exhibiting the support pins, and such a spring plate can be designed even with small dimensions with appropriately stable material.

A particularly simple way to unlock the parts of the tension member that are connected to one another by nonpositive locking in the direction of movement can be achieved in that, to lock the two parts of the tension member detachably connected to one another, a spring-loaded bolt is provided which can be engaged in radial bores of the parts of the tension member that are in alignment with one another. Such a spring-loaded bolt can be brought out of engagement with the corresponding bores or recesses in alignment against the force of a spring so that at least one of the components of the tension member can be freely shifted in relation to the remaining components of the tension member. The original basic setting for the minimum backward lean or the basic setting of the elastic force is in no way altered in such a release or unlocking. By elastic engagement of such a spring-loaded bolt the nonpositive locking coupling of the parts with one another can again be attained automatically on the predetermined locking place, so that the operational position is directly adjusted if the upper is again shifted from the walking position to a forward lean position.

To position such a locking bolt securely and to guarantee at the same time the possibility of adjusting the basic setting, particularly of the minimum angle of forward lean or the maximum backward lean during use, the design is advantageously chosen so that the part of the tension member pivotably hinged on the shell is encompassed by a coupling link with which the part pivotably hinged on the shell can be locked detachably, and so that the coupling link is nonpositively connected to the spring-loaded part of the tension member and so that it can be adjusted lengthwise. Such an additional component or such a coupling link makes it possible to place small and stable devices for adjusting the basic setting of the forward lean position, and the design is advantageously chosen so that the coupling link partially encompasses a knurled nut which can be bolted on the outside of the spring-loaded part of the tension member. Such a knurled nut can be bolted on exposed parts through the coupling link, so that by the lengthwise variable positioning of the coupling link on the parts of the tension member that work together with the spring the basic setting and thus the forward lean can be preset.

The invention is explained below in greater detail with the embodiments represented in the drawing. In the drawing FIG. 1 shows a ski shoe according to the invention with a multipart tension member connecting the shell and the upper or cuff;

Figure 1:
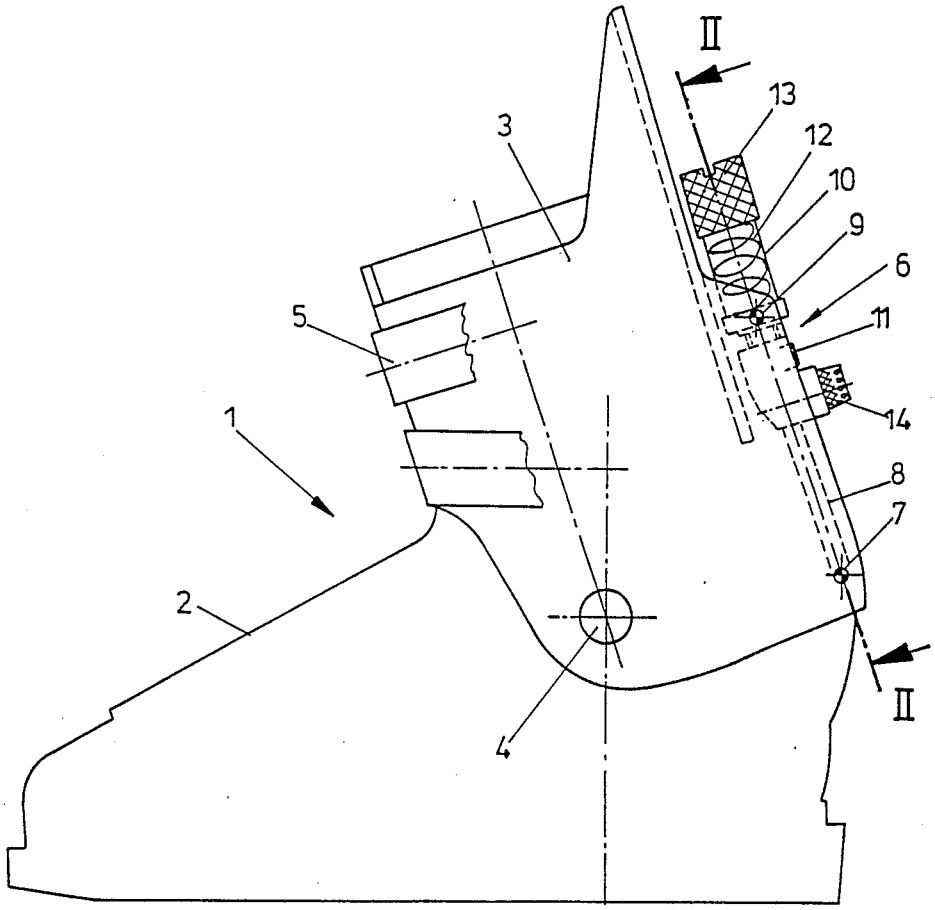

In FIG. 1 a ski shoe is designated by 1 in which on shell 2 an upper or cuff 3 is pivotably hinged around axis 4. For closing the ski shoe closing elements 5 are indicated on upper 3. On ski shoe 1 in the heel area, for connecting shell 2 with the pivotable upper or pivotable cuff 3, tension member 6 is provided which consists of first part 8 pivotably attached to shell 2 around axis 7, as well as second part 10 pivotably attached to upper or cuff 3 around axis 9 and coupling link 11 encompassing part 8, as will be explained in greater detail below referring to the figures below. Spring 12 indicated diagrammatically works together with part 10 and the absorbing hardness of this spring can be set by knurled nut 13. To unlock parts 8 and 10 that can be slid lengthwise relative to one another, unlocking element 14 on coupling link 11 is indicated in FIG. 1.

Figure 2:
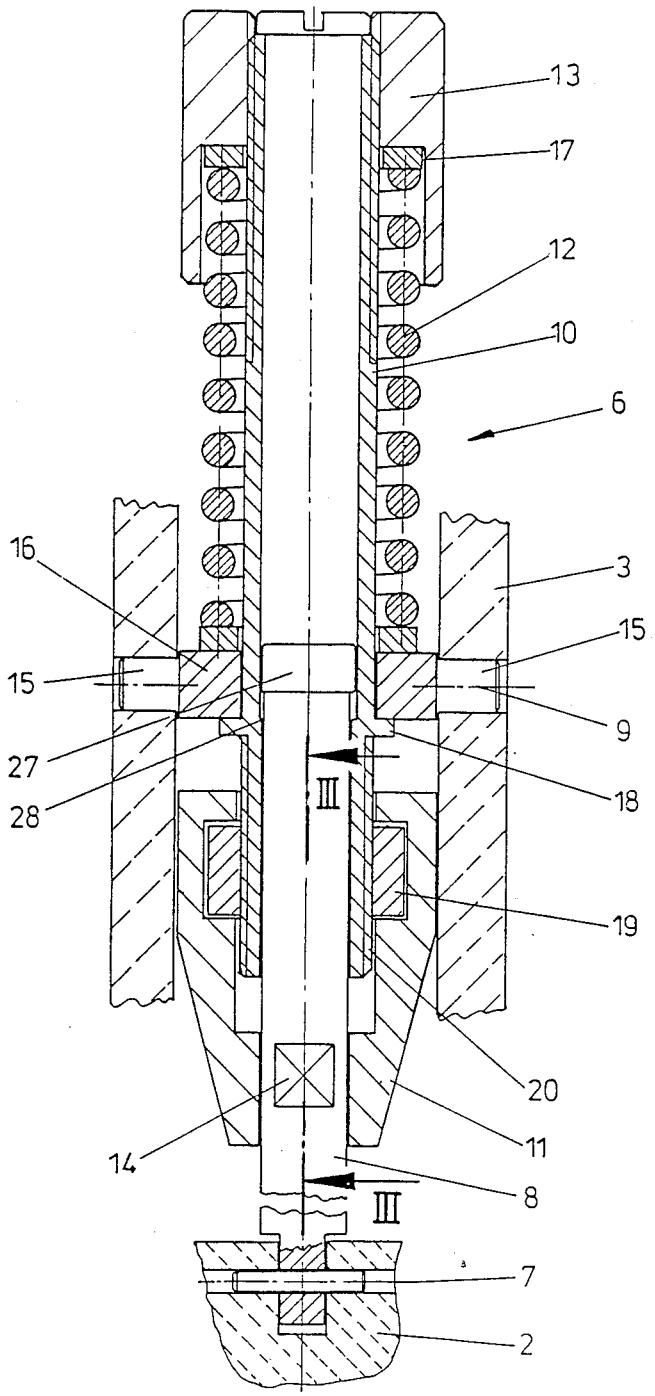
FIG. 2 shows a section through the tension member according to the invention along line II—II of FIG. 1 in enlarged representation.

In the enlarged representation of tension member 6 in FIG. 2 the reference numbers of FIG. 1 are retained. First part 8 of the tension member that can be attached to shell 2 so that it can be pivoted around axis 7 is pivotably attached on the bottom shell and is overlapped by coupling link 11. Part 8 dips into the second part of tension member 6 on upper or cuff 3 pivotable around axis 9, and this second part is encompassed by spring 12 whose absorbing hardness can be adjusted by knurled nut 13. Pivot axis 9 of second part 10 is defined by support pins 15 which are carried by disk 16 serving as a spring plate for spring 12 and which is pivotably positioned in a bearing block on upper or cuff 3 and is not represented in greater detail. Second spring plate 17 for spring 12 is carried in this case by knurled nut 13. For limiting the maximum backward lean in the locked position of parts 8 and 10 of the tension member that can be slid lengthwise to one another, the tension member further exhibits stops 18 working together with disk 16 and these stops limit a backward movement of upper or cuff 3. In this case, the distance of stops 18 from hinged axis 7 of the first part of tension member 8 pivotably hinged on shell 2 can be adjusted by knurled nut 19 positioned in coupling link 11 and this nut works together with thread 20 provided on the outside of part 10. The locking element in FIG. 2 is designated again with 14.

With the horizontal swing of the upper or cuff 3 into a forward lean position in relation to bottom shell 3 in the locked position of parts 8 and 10 of the tension member, a lifting of disk 16 takes place by the synchronization of stops 18 by way of support pins 15 and thus a compression of spring 12 whereby the forward lean movement is elastically cushioned. The maximum backward lean in this position is limited, as already indicated above, by stops 18.

Figure 3:
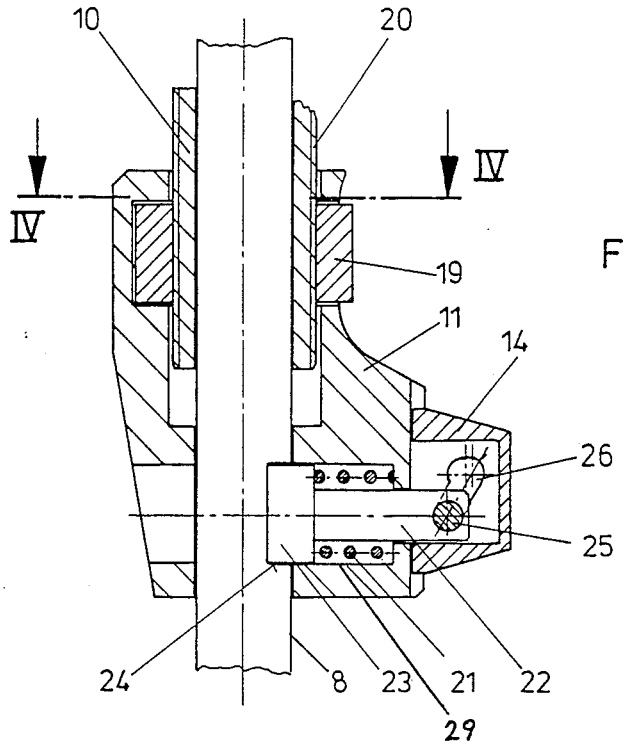
FIG. 3 shows a section along line III—III of FIG. 2 through the locking mechanism and FIG. 4 shows a section along line IV—IV of FIG. 3.

The locking of both parts 8 and 10 of tension member 6 that can be slid lengthwise to one another is represented in detail in FIG. 3, and the same reference numbers are retained for the same components. The first part flexibly connected to shell 2 is again designated with 8 and is encompassed by part 10 that works together with the upper. For adjusting the forward lean, knurled nut 19 placed in coupling link 11 which also exhibits the locking mechanism, is again provided. The locking is made possible by bolt 22 loaded by spring 21 and this bolt is placed in coupling link 11 in bore 29. In the locked position represented in FIG. 3, head 23 of the bolt engages a radial recess or bore 24 of part 8 and by coupling link 11 results in a lengthwise locking of parts 8 and 10 that can be slid in relation to one another, since part 10 working together with the upper is kept stationary relative to coupling link 11 by knurled nut 19. When there is a movement of an actuating element 25 of bolt 22 against the force of spring 21 in guide 26, head 23 of the bolt moves out of engagement with bore or recess 24 in part 8 so that this part 8 becomes capable of being slid lengthwise in part 10 and thus upper or cuff 3 can be pivoted into an essentially upright walking position in relation to shell 2 over a large angular sector. To prevent part 8 from moving out of part 10 that surrounds it, part 8 exhibits a widened head area 27 and part 10 exhibits stops 28 on its inner surface, as can be seen in FIG. 2. To lock both parts 8 and 10 that can be slid lengthwise to one another in the forward lean position once it has been selected, it is sufficient to move control element 25 of bolt 22 in the direction of the position shown in FIG. 3, whereupon when a corresponding forward lean of upper or cuff 3 is assumed in relation to the shell and thus to a corresponding sliding of part 8 relative to part 10 with an alignment of head 23 with recess 24 in part 8, the bolt engages part 8 and thus locking is achieved.

Figure 4:
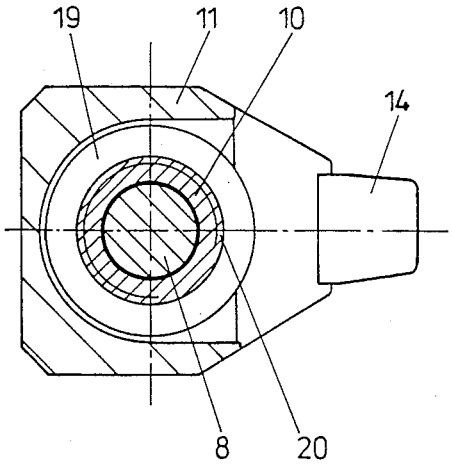

In FIG. 4 it is represented in a further step how part 8 is overlapped by the second part of tension member 10 and this second part 10 is kept stationary relative to coupling link 11 by knurled nut 19.

I claim:

1. Ski shoe with a shell (2) and an upper or cuff (3) pivotably hinged on the shell, in which shell and upper or cuff are connected to one another by spring element (12) and tension member (6) engaging the spring element is pivotably attached on shell (2), said tension member (6) consists of at least two parts (8, 10) that can be slid lengthwise in relation to one another and means permitting said parts (8, 10) of tension member (6) to be detachably locked with one another in at least one slide position, and a first part (8) of tension member (6) is pivotably attached on the shell and a second part (10) of the tension member is pivotably attached to upper or cuff (3), characterized in that spring (12) placed between second part (10) of tension member (6) and upper or cuff (3) encompasses second part (10) from the outside and is placed between a spring plate (17) that can be slid in the axial direction of second part (10) and can be attached in the respective slide position and a disk (16) exhibiting support pins (15), wherein disk (16) exhibiting support pins (15) on the outside of second part (10) can be slid in its axial direction against the force of spring (12).

2. Ski shoe according to claim 1, wherein first part (8) of tension member (6) pivotably attached on shell (2) is placed so that it can be dipped into second part (10) of tension member (6) that passes through a bearing on upper or cuff (3).

3. Ski shoe according to claim 2, wherein second part (10) of tension member (6) that passes through the bearing on upper or cuff (3) exhibits stops (18) for limiting the swing path of cuff or upper (3) into the backward lean when both parts (8, 10) of tension member (6) are in the locked position.

4. Ski shoe according to claim 1 wherein said disk (16) exhibiting support pins (15), with a maximum horizontal swing of the upper or cuff (3) into the backward lean, works together with stops (18) for limiting the backward lean on the outside of second part (10) of tension member (6) and wherein support pins (15) are taken up in recesses or bores of a bearing block attached on upper or cuff (3), formed as one piece with upper or cuff (3).

5. Ski shoe according to claim 1, wherein said means for locking of the two parts (8, 10) of tension member (6) detachably connected to one another comprises a spring-loaded bolt (22) provided which can be engaged in radial bores (24, 29) aligned with one another of parts (8, 10) of tension member (6).

6. Ski shoe according to claim 1, wherein part (8) of tension member (10) pivotably hinged on shell (2) is encompassed by coupling link (11) with which part (8) pivotably hinged on shell (2) can be detachably locked and wherein coupling link (11) is connected nonpositively and can be adjusted lengthwise with spring-loaded part (10) of tension member (6).

7. Ski shoe according to claim 6, wherein coupling link (11) partially encompasses knurled nut (19) which can be bolted on the outside of spring-loaded part (10) of tension member (6).

* * * * *